US006884047B1

(12) United States Patent
Liepert et al.

(10) Patent No.: US 6,884,047 B1
(45) Date of Patent: Apr. 26, 2005

(54) COMPACT SCROLL PUMP

(75) Inventors: Anthony G. Liepert, Lincoln, MA (US); Jeffrey C. Warren, Westford, MA (US); Robert M. Curry, Jr., Arlington, MA (US)

(73) Assignee: Varian, Inc., Palo Alto, CA (US)

( * ) Notice: Subject to any disclaimer, the term of this patent is extended or adjusted under 35 U.S.C. 154(b) by 13 days.

(21) Appl. No.: 10/689,169

(22) Filed: Oct. 20, 2003

(51) Int. Cl.[7] ..... F01C 1/02
(52) U.S. Cl. ..... 418/55.1; 418/55.2; 418/5
(58) Field of Search ..... 418/55.1, 55.2, 418/55.3, 5, 6

(56) References Cited

U.S. PATENT DOCUMENTS

| | | | | |
|---|---|---|---|---|
| 3,560,119 A | * | 2/1971 | Busch et al. | 418/55.3 |
| 4,477,238 A | | 10/1984 | Terauchi | |
| 4,650,405 A | | 3/1987 | Iwanami et al. | |
| 5,304,047 A | | 4/1994 | Shibamoto | |
| 5,336,068 A | * | 8/1994 | Sekiya et al. | 418/55.2 |
| 5,616,015 A | | 4/1997 | Liepert | |
| 6,050,792 A | | 4/2000 | Shaffer | |
| 6,746,224 B2 | * | 6/2004 | Itoh et al. | 418/55.2 |

FOREIGN PATENT DOCUMENTS

| | | | | |
|---|---|---|---|---|
| JP | 03156185 A | * | 7/1991 | F04C/18/02 |
| JP | 04121483 A | * | 4/1992 | F04C/18/02 |

* cited by examiner

*Primary Examiner*—Theresa Trieu
(74) *Attorney, Agent, or Firm*—William McClellan; Bella Fishman

(57) ABSTRACT

A compact scroll pump includes a scroll set having an inlet and an outlet, and a drive mechanism. The scroll set includes a stationary scroll blade extending from a stationary plate and an orbiting scroll blade extending from an orbiting plate. The stationary and orbiting scroll blades are intermeshed together to define one or more interblade pockets. The orbiting scroll blade is located on a first side of the orbiting plate, and the drive mechanism is operatively coupled to a second side of the orbiting plate for producing orbiting motion of the orbiting scroll blade relative to the stationary scroll blade. The drive mechanism includes a motor and a crankshaft having an axis of rotation, and an orbiting bearing coupled between the crankshaft and the orbiting plate. The scroll set is configured such that an imaginary plane perpendicular to the axis of rotation passes through the orbiting bearing and at least a portion of the orbiting scroll blade.

14 Claims, 2 Drawing Sheets

COMPACT SCROLL PUMP

FIELD OF THE INVENTION

This invention relates to scroll-type vacuum pumps and, more particularly, to scroll-type vacuum pumps which have a compact design.

BACKGROUND OF THE INVENTION

Scroll devices are well known in the field of vacuum pumps and compressors. In a scroll device, a movable spiral blade orbits with respect to a fixed spiral blade within a housing. The movable spiral blade is connected to an eccentric drive mechanism. The configuration of the scroll blades and their relative motion traps one or more volumes or "pockets" of a fluid between the blades and moves the fluid through the device. Most applications apply rotary power to pump a fluid through the device. Oil-lubricated scroll devices are widely used as refrigerant compressors. Other applications include expanders, which operate in reverse from a compressor, and vacuum pumps. Scroll pumps have not been widely adopted for use as vacuum pumps, mainly because the cost of manufacturing a scroll pump is significantly higher than a comparably-sized, oil-lubricated vane pump. Dry scroll pumps have been used in applications where oil contamination is unacceptable.

A scroll pump includes stationary and orbiting scroll elements, and a drive mechanism. The stationary and orbiting scroll elements each include a scroll plate and a spiral scroll blade extending from the scroll plate. The scroll blades are intermeshed together to define interblade pockets. The drive mechanism produces orbiting motion of the orbiting scroll element relative to the stationary scroll element so as to cause the interblade pockets to move toward the pump outlet.

Various scroll pump designs have been proposed in the prior art to increase performance and to reduce pump size. A two stage scroll pump is disclosed in U.S. Pat. No. 5,616,015, issued Apr. 1, 1997 to Liepert. U.S. Pat. No. 4,650,405, issued Mar. 17, 1987 to Iwanami et al., discloses a scroll pump with axially-spaced pumping chambers in series. A double-sided first stage feeds a single-sided second stage. A scroll compressor having two stages on opposite sides of an orbiting plate is disclosed in U.S. Pat. No. 5,304,047, issued Apr. 19, 1994 to Shibamoto. A single-sided scroll compressor having scroll blades with portions of different axial heights is disclosed in U.S. Pat. No. 4,477,238, issued Oct. 16, 1984 to Terauchi. A multi-stage, single-sided scroll compressor is disclosed in U.S. Pat. No. 6,050,792, issued Apr. 18, 2000 to Shaffer.

The prior art scroll pump designs have not been entirely satisfactory with respect to both performance and physical size. Accordingly, there is a need for improved scroll-type vacuum pumping apparatus.

SUMMARY OF THE INVENTION

According to a first aspect of the invention, vacuum pumping apparatus is provided. The vacuum pumping apparatus comprises a scroll set having an inlet and an outlet, and a drive mechanism. The scroll set comprises a stationary scroll element including a stationary scroll blade extending from a single side of a stationary plate and an orbiting scroll element including an orbiting scroll blade extending from a single side of an orbiting plate to form a single-sided scroll set, wherein the stationary and orbiting scroll blades are intermeshed together to define one or more interblade pockets. The drive mechanism is operatively coupled to the orbiting scroll element for producing orbiting motion of the orbiting scroll blade relative to the stationary scroll blade so as to cause the one or more interblade pockets to move toward the outlet. The drive mechanism includes a motor and a crankshaft having an axis of rotation, and an orbiting bearing coupled between the crankshaft and the orbiting plate. The scroll set is configured such that an imaginary plane perpendicular to the axis of rotation passes through the orbiting bearing and at least a portion of the orbiting scroll blade. The crankshaft may include an eccentric portion, and the orbiting bearing may be coupled between the eccentric portion of the crankshaft and the orbiting plate.

The scroll set may include a first pumping stage in series with a second pumping stage. The imaginary plane may pass through at least a portion of the first stage. The first pumping stage may have a first axial depth, and the second pumping stage may have a second axial depth. The first axial depth may be greater than the second axial depth. The stationary scroll blade of the first pumping stage and the stationary scroll blade of the second pumping stage may extend axially from a common plane of the stationary plate toward the drive mechanism.

The vacuum pumping apparatus may further comprise a counterweight assembly connected to the crankshaft. In some embodiments, the counterweight assembly comprises a single counterweight. In other embodiments, the counterweight assembly comprises at least two counterweights. The imaginary plane may pass through at least a portion of the counterweight assembly.

According to another aspect of the invention, a compact scroll pump is provided. The compact scroll pump comprises a scroll set having an inlet and an outlet, the scroll set comprising a stationary scroll element including a stationary scroll blade extending from a stationary plate and an orbiting scroll element including an orbiting scroll blade extending from an orbiting plate, wherein the stationary and orbiting scroll blades are intermeshed together to define one or more interblade pockets. The orbiting scroll blade is located on a first side of the orbiting plate, and the drive mechanism is operatively coupled to a second side of the orbiting plate for producing orbiting motion of the orbiting scroll blade relative to the stationary scroll blade. The drive mechanism includes a motor and a crankshaft having an axis of rotation, and an orbiting bearing coupled between the crankshaft and the orbiting plate. The scroll set is configured such that an imaginary plane perpendicular to the axis of rotation passes through the orbiting bearing and at least a portion of the orbiting scroll blade.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
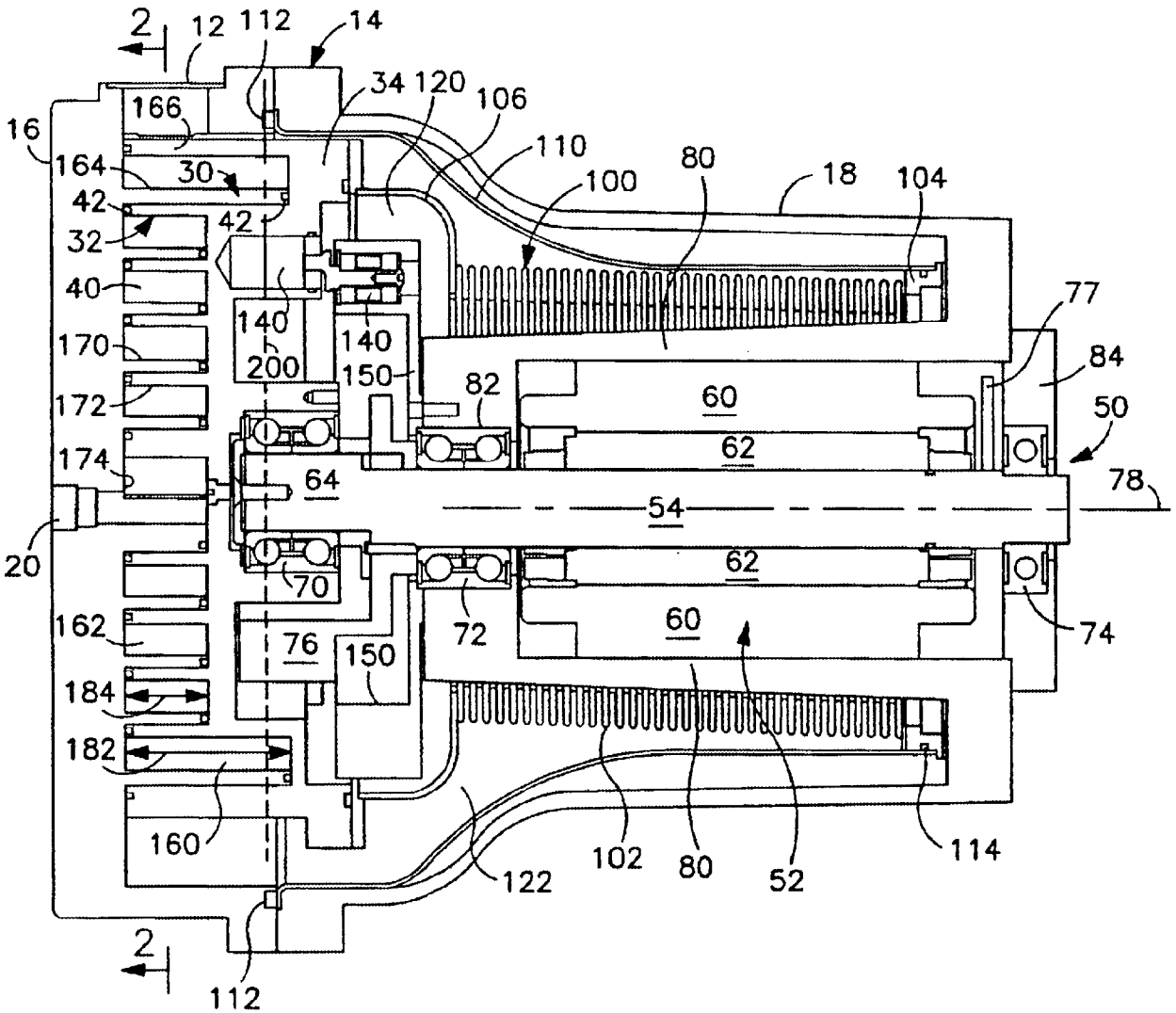
FIG. 1 is a schematic, cross-sectional diagram of a scroll-type vacuum pumping apparatus in accordance with an embodiment of the invention.
Figure 2:
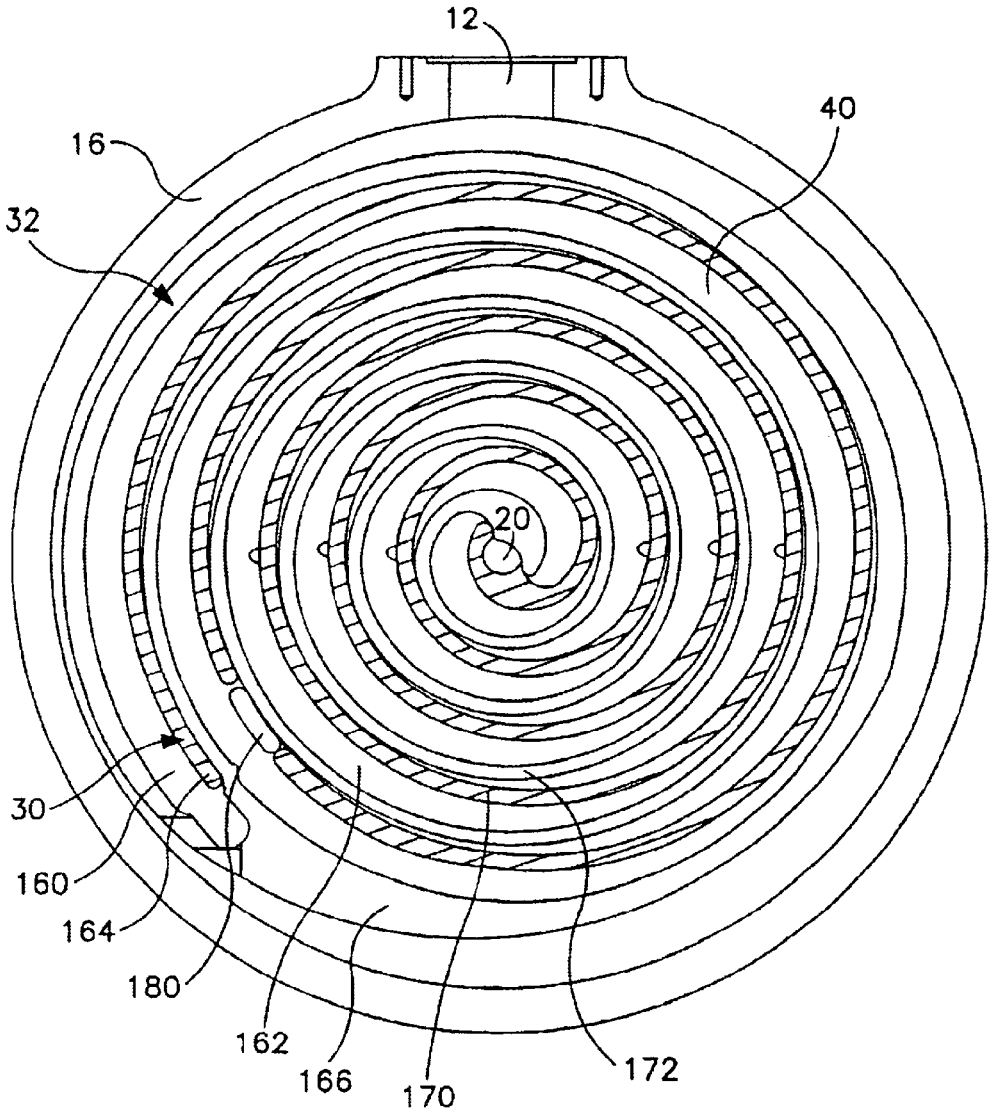
FIG. 2 is a schematic, cross-sectional diagram of the scroll-type vacuum pumping apparatus, taken along the line 2—2 of FIG. 1.

A scroll-type vacuum pump, or scroll pump, in accordance with an embodiment of the invention is shown in FIGS. 1 and 2. A single-ended vacuum pump is shown. A gas, typically air, is evacuated from a vacuum chamber or other equipment (not shown) connected to an inlet 12 of the pump. A pump housing 14 includes a stationary scroll plate 16 and a frame 18. The pump further includes an outlet 20 for exhaust of the gas being pumped.

The scroll pump includes a set of intermeshed, spiral-shaped scroll blades. In FIG. 1, a scroll set includes a stationary scroll blade 30 extending from stationary scroll plate 16 and an orbiting scroll blade 32 extending from an orbiting scroll plate 34. Scroll blades 30 and 32 are preferably formed integrally with scroll plates 16 and 34, respectively, to facilitate thermal transfer and to increase the mechanical rigidity and durability of the pump. Scroll blade 30 and scroll plate 16 constitute a stationary scroll element, and scroll blade 32 and scroll plate 34 constitute an orbiting scroll element. Scroll blades 30 and 32 extend axially toward each other and are intermeshed together to form interblade pockets 40. Tip seals 42 located in grooves at the tips of the scroll blades provide sealing between the scroll elements. Orbiting motion of scroll blade 32 relative to scroll blade 30 produces a scroll-type pumping action of the gas entering into the interblade pockets 40 between the scroll blades.

A drive mechanism 50 for the scroll pump includes a motor 52 coupled through a crankshaft 54 to orbiting scroll plate 34. Motor 52 includes a stator 60 and a rotor 62, which is affixed to crankshaft 54. An end 64 of crankshaft 54 has an eccentric configuration with respect to the main part of crankshaft 54 and is coupled to orbiting scroll plate 34 through an orbiting bearing 70. Crankshaft 54 is coupled to pump housing 14 through a main bearing 72 and a rear bearing 74. Crankshaft 54 rotates in bearings 72 and 74 about an axis of rotation 78. The eccentric configuration of crankshaft end 64 produces orbiting motion of scroll blade 32 relative to scroll blade 30, thereby pumping gas from inlet 12 to outlet 20.

A counterweight assembly connected to crankshaft 54 provides balanced operation of the vacuum pump when motor 52 is energized. In some embodiments, the counterweight assembly includes a single counterweight 76 connected to crankshaft 54. In other embodiments, the counterweight assembly includes at least two counterweights 76 and 77 connected to crankshaft 54.

The frame 18 includes a reentrant center hub 80 which extends inwardly toward scroll blades 30 and 32 and which defines a cavity for receiving motor 52 and crankshaft 54. Center hub 80 defines a bore 82 for mounting main bearing 72. An end plate 84 covers the cavity defined by center hub 80 and serves as a mounting element for rear bearing 74.

The scroll pump further includes a bellows assembly 100 coupled between a first stationary component of the vacuum pump and the orbiting scroll plate 34 so as to isolate a first volume inside bellows assembly 100 and a second volume outside bellows assembly 100. One end of bellows assembly 100 is free to rotate during motion of the orbiting scroll blade 32 relative to the stationary scroll blade 30. As a result, the bellows assembly 100 does not synchronize the scroll blades and is not subjected to significant torsional stress during operation.

In the embodiment of FIGS. 1 and 2, bellows assembly 100 includes a bellows 102, a first flange 104 sealed to a first end of bellows 102 and a second flange 106 sealed to a second end of bellows 102. Flange 104 may be in the form of a ring that is rotatably mounted on center hub 80. Flange 106 may have a bell shape or a flared shape for fixed attachment to orbiting scroll plate 34.

The scroll pump may further include an optional bellows can 110 coupled between housing 14 and first flange 104. Bellows can 110 may have a tubular shape of variable diameter. One end of bellows can 110 may be secured between frame 18 and stationary scroll plate 16 and may be sealed by an elastomer ring 112. The other end of bellows can 110 may be rotatably coupled to the first flange 104 and sealed thereto with an elastomer ring 114. Thus, flange 104 is free to rotate between bellows can 110 and center hub 80. Bellows can 110 relaxes the requirement for frame 18 to be hermetically sealed.

Bellows assembly 100 is coupled between center hub 80 (the first stationary component) and orbiting scroll plate 34. In the embodiments of FIGS. 1 and 2, bellows assembly 100 has a fixed connection to orbiting scroll plate 34 and a rotatable connection to bellows can 110. Bellows assembly 100 provides isolation between a first volume 120 inside bellows assembly 100 and a second volume 122 outside bellows assembly 100. In the embodiment of FIG. 1, first volume 120 is in gas communication with the external environment, typically at atmospheric pressure, and second volume 122 is at or near the vacuum pressure of pump inlet 12.

The scroll pump further includes a synchronization mechanism coupled between the orbiting scroll plate 34 and a second stationary component of the vacuum pump. In the embodiment of FIGS. 1 and 2, the synchronization mechanism includes a set of three synchronization cranks, each coupled between orbiting scroll plate 34 and a second stationary component of the vacuum pump. In FIG. 1, a synchronization crank 140 is shown. Synchronization crank 140 and two additional synchronization cranks (not shown) are equally spaced from axis 78 and are equally spaced with respect to each other. In the embodiment of FIGS. 1 and 2, a mounting plate 150 is secured to center hub 80, and the stationary ends of the synchronization cranks are connected to mounting plate 150 (the second stationary component). The synchronization cranks may be of standard configuration as known in the scroll pump art.

In the embodiment of FIGS. 1 and 2, the scroll set includes a first pumping stage 160 and a second pumping stage 162 connected in series between inlet 12 and outlet 20. First pumping stage 160 includes first stage stationary blade 164 and first stage orbiting blade 166. Second pumping stage 162 includes a second stage stationary blade 170 and second stage orbiting blade 172. First stage stationary blade 164 and second stage stationary blade 170 together constitute stationary scroll blade 30. First stage orbiting blade 166 and second stage orbiting blade 172 together constitute orbiting scroll blade 32. As shown in FIG. 2, first stage stationary blade 164 is separated from second stage stationary blade 170 by an interstage relief port 180. First stage orbiting blade 166 and second stage orbiting blade 172 are connected together to form a continuous orbiting scroll blade.

As shown in FIG. 1, first stage orbiting blade 166 and second stage orbiting blade 172 extend from a first side of orbiting scroll plate 34, and crankshaft 54 is coupled via orbiting bearing 70 to a second side of orbiting scroll plate 34. First stage stationary blade 164 and second stage stationary blade 170 extend from a common plane 174 of stationary scroll plate 16. The configuration of FIGS. 1 and 2 constitutes a single-sided, two-stage scroll pump. The first pumping stage 160 and the second pumping stage 162 are connected in series between inlet 12 and outlet 20.

As further illustrated in FIG. 1, first stage stationary blade 164 and first stage orbiting blade 166 have a first axial depth 182, and second stage stationary blade 170 and second stage orbiting blade 172 have a second axial depth 184. In the embodiment of FIGS. 1 and 2, the first axial depth 182 is greater than the second axial depth 184 to achieve efficient pumping operation.

As shown in FIG. 1, the scroll set is configured such that at least a portion of first pumping stage 160 is located radially outward of crankshaft 54. More particularly, at least a portion of first pumping stage 160 is located radially outward of eccentric crankshaft end 64 and orbiting bearing 70. In addition, synchronization crank 140 and two additional synchronization cranks (not shown) are located between orbiting bearing 70 and first pumping stage 160. This configuration permits a single counterweight 76 to be used for both static and dynamic balancing of the scroll pump.

As shown in FIG. 1, an imaginary plane 200 may be drawn perpendicular to axis of rotation 78 through eccentric end 64 of crankshaft 54 and through orbiting bearing 70. Imaginary plane 200 passes through first pumping stage 160. More particularly, imaginary plane 200 passes through first stage stationary blade 164 and first stage orbiting blade 166. Thus, portions of first stage stationary blade 164 and first stage orbiting blade 166 are located radially outward of eccentric end 64 of crankshaft 54 and orbiting bearing 70. In addition, imaginary plane 200 passes through synchronization crank 140 and counterweight 76. Thus, the three synchronization cranks and the counterweight 76 are located radially outward of eccentric end 64 of crankshaft 54 and orbiting bearing 70. Furthermore, the synchronization cranks are located within an outer periphery of stationary scroll blade 30 and orbiting scroll blade 32. Stated differently, portions of first stage stationary blade 164, first stage orbiting blade 166, synchronization crank 140, counterweight 76, orbiting bearing 70 and eccentric end 64 of crankshaft 54 are axially aligned. The result is a relatively short, compact scroll pump configuration. Referring to FIG. 1, it may be observed that the distance between eccentric end 64 of crankshaft 54 and the end of the scroll pump as defined by stationary scroll plate 16 is relatively small as compared with prior art scroll pump configurations. In effect, components of the scroll pump surround crankshaft 54, and the length of the scroll pump is reduced in comparison with prior art scroll pump configurations.

The two-stage, single-sided scroll pump shown in FIGS. 1 and 2 and described herein requires less material and machining time than prior art scroll pumps. The overall length of the scroll pump is reduced in comparison with prior art scroll pumps. The center of mass of the orbiting scroll plate 34 is relatively close to the centerline of orbiting bearing 70. The centripetal load due to orbiting plate 34 is more directly over orbiting bearing 70, which reduces the overturning moment that the orbiting bearing must support. Radial loads generated on orbiting plate 34 are relatively close to the centerline of orbiting bearing 70, which also reduces the overturning moment the bearing must support.

Having thus described the inventive concepts and a number of exemplary embodiments, it will be apparent to those skilled in the art that the invention may be implemented in various ways, and that modifications and improvements will readily occur to such persons. Thus, the examples given are not intended to be limiting, and are provided by way of example only. The invention is limited only as required by the following claims and equivalents thereto.

What is claimed is:

1. Vacuum pumping apparatus comprising:

a scroll set having an inlet and an outlet, said scroll set comprising a stationary scroll element including a stationary scroll blade extending from a single side of a stationary plate and an orbiting scroll element including an orbiting scroll blade extending from a single side of an orbiting plate to form a single-sided scroll set, wherein said stationary and orbiting scroll blades are intermeshed together to define one or more interblade pockets;

a drive mechanism operatively coupled to said orbiting scroll element for producing orbiting motion of said orbiting scroll blade relative to said stationary scroll blade so as to cause said one or more interblade pockets to move toward said outlet, said drive mechanism including a motor and a crankshaft having an axis of rotation, and an orbiting bearing coupled between said crankshaft and said orbiting plate, wherein the scroll set is configured such that an imaginary plane perpendicular to the axis of rotation passes through the orbiting bearing and at least a portion of the orbiting scroll blade; and said scroll set further comprising a first pumping stage in series with a second pumping stage and wherein the imaginary plane passes through at least a portion of the first pumping stage.

2. Vacuum pumping apparatus as defined in claim 1, wherein the first pumping stage has a first axial depth and the second pumping stage has a second axial depth, wherein the first axial depth is greater than the second axial depth and wherein the stationary scroll blade of the first pumping stage and the stationary scroll blade of the second pumping stage extend axially from a common plane of the stationary plate toward the drive mechanism.

3. Vacuum pumping apparatus as defined in claim 1, wherein said crankshaft includes an eccentric portion and said orbiting bearing is coupled between the eccentric portion of said crankshaft and said orbiting plate.

4. Vacuum pumping apparatus as defined in claim 1, further comprising a counterweight assembly connected to said crankshaft.

5. Vacuum pumping apparatus as defined in claim 4, wherein said counterweight assembly comprises a single counterweight.

6. Vacuum pumping apparatus as defined in claim 4, wherein said counterweight assembly comprises at least two counterweights.

7. Vacuum pumping apparatus as defined in claim 4, wherein the imaginary plane passes through at least a portion of the counterweight assembly.

8. A compact scroll pump comprising:

a scroll set having an inlet and an outlet, said scroll set comprising a stationary scroll element including a stationary scroll blade extending from a stationary plate and an orbiting scroll element including an orbiting scroll blade extending from an orbiting plate, wherein said stationary and orbiting scroll blades are intermeshed together to define one or more interblade pockets and wherein said orbiting scroll blade is located on a first side of said orbiting plate;

a drive mechanism operatively coupled to a second side of said orbiting plate for producing orbiting motion of said orbiting scroll blade relative to said stationary scroll blade so as to cause said one or more interblade pockets to move toward said outlet, said drive mechanism including a motor and a crankshaft having an axis of rotation, and an orbiting bearing coupled between said crankshaft and said orbiting plate, wherein the scroll set is configured such that an imaginary plane perpendicular to the axis of rotation passes through the orbiting bearing and at least a portion of the orbiting scroll blade; and said scroll set further comprising a first pumping stage in series with a second pumping stage and wherein the imaginary plane passes through at least a portion of the first stage.

9. A compact scroll pump as defined in claim 8, wherein the first pumping stage has a first axial depth and the second pumping stage has a second axial depth, wherein the first axial depth is greater than the second axial depth and wherein the stationary scroll blade of the first pumping stage and the stationary scroll blade of the second pumping stage extend axially from a common plane of the stationary plate toward the drive mechanism.

10. A compact scroll pump as defined in claim 8, wherein said crankshaft includes an eccentric portion and said orbiting bearing is coupled between the eccentric portion of said crankshaft and said orbiting plate.

11. A compact scroll pump as defined in claim 8, further comprising a counterweight assembly connected to said crankshaft.

12. A compact scroll pump as defined in claim 11, wherein said counterweight assembly comprises a single counterweight.

13. A compact scroll pump as defined in claim 11, wherein said counterweight assembly comprises at least two counterweights.

14. A compact scroll pump as defined in claim 11, wherein the imaginary plane passes through at least a portion of the counterweight assembly.

* * * * *